US008465188B2

(12) United States Patent
Sasaki et al.

(10) Patent No.: US 8,465,188 B2
(45) Date of Patent: Jun. 18, 2013

(54) LIGHT SOURCE MODULE AND VEHICLE LAMP

(75) Inventors: Yasutaka Sasaki, Shizuoka (JP); Hiroyuki Ishida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 245 days.

(21) Appl. No.: 12/935,350

(22) PCT Filed: Apr. 21, 2009

(86) PCT No.: PCT/JP2009/057929

§ 371 (c)(1), (2), (4) Date: Sep. 29, 2010

(87) PCT Pub. No.: WO2009/131125

PCT Pub. Date: Oct. 29, 2009

(65) Prior Publication Data

US 2011/0026266 A1 Feb. 3, 2011

(30) Foreign Application Priority Data

Apr. 22, 2008 (JP) ..... 2008-111815

(51) Int. Cl.
*F21S 8/10* (2006.01)
*F21V 21/00* (2006.01)

(52) U.S. Cl.
USPC ..... 362/545; 362/543; 362/800; 362/217.01; 362/230; 362/311.02

(58) Field of Classification Search
USPC ..... 362/507, 538, 540–545, 612, 555, 362/800, 97.3, 184, 209, 217.01, 219, 227, 362/230, 231, 236, 238, 240, 249.02, 268, 362/311.02
See application file for complete search history.

(56) References Cited

U.S. PATENT DOCUMENTS

| | | | | |
|---|---|---|---|---|
| 7,686,486 | B2 * | 3/2010 | Tessnow et al. | 362/487 |
| 2005/0041434 | A1 | 2/2005 | Yatsuda et al. | |
| 2007/0091602 | A1 * | 4/2007 | van Voorst Vader et al. | 362/244 |

FOREIGN PATENT DOCUMENTS

| | | | |
|---|---|---|---|
| CN | 1583465 | A | 2/2005 |
| EP | 1526581 | A2 | 4/2005 |
| JP | 2004247150 | A | 9/2004 |
| JP | 2005-63706 | A | 3/2005 |
| JP | 2005-294166 | A | 10/2005 |

OTHER PUBLICATIONS

International Search Report issued in PCT/JP2009/057929, mailed on Jul. 21, 2009, with translation, 7 pages.
Written Opinion issued in PCT/JP2009/057929, mailed on Jul. 21, 2009, 3 pages.
Office Action Issued in Japanese Application No. 2008-111815, Dated Aug. 14, 2012 (5 Pages with English Translation).
English Patent Abstract of JP 2004-247150, Publication Date Sep. 2, 2004 (1 Page).

* cited by examiner

*Primary Examiner* — Evan Dzierzynski
*Assistant Examiner* — Danielle Allen
(74) *Attorney, Agent, or Firm* — Osha Liang LLP

(57) ABSTRACT

A light source module for a vehicle lamp, including an optical system that guides light emitted from the light source module in a certain irradiation direction and has an optical center, the light source module has a plurality of semiconductor light emitting elements disposed in a straight line and electrically connected to each other in series. One of the semiconductor light emitting elements that is positioned closest to the optical center of the optical system has a light emitting area that is smallest of the plurality of the semiconductor light emitting elements.

8 Claims, 7 Drawing Sheets

LIGHT SOURCE MODULE AND VEHICLE LAMP

TECHNICAL FIELD

The present invention relates to a light source module using semiconductor light emitting elements and a vehicle lamp using the light source module.

BACKGROUND ART

A vehicle headlamp using semiconductor light emitting elements such as LEDs (Light Emitting Diodes) has been known. The vehicle headlamp needs to form a certain light distribution pattern from the viewpoint of safety or the like.

Further, a sufficient amount of light has to be secured in the vehicle headlamp. For this reason, it is studied that a plurality of semiconductor light emitting elements are used in the vehicle headlamp. For example, Patent Document 1 discloses a vehicle headlamp using a light source module including a plurality of semiconductor light emitting elements. The semiconductor light emitting elements are electrically connected in series, have substantially the same light emitting area, and are disposed in a straight line.

[Patent Document 1] JP-A-2005-294166

SUMMARY OF THE INVENTION

If the light source module disclosed in Patent Document 1 is used in a vehicle headlamp, the vehicle headlamp is generally configured such that the optical center of the optical system, which guides light emitted from the light source module in front of the vehicle, is positioned on the middle line of an array of the semiconductor light emitting elements. In a direct-projection type vehicle headlamp using, for example, a projection lens as an optical component, the optical center of the optical system is a rear focal point of the projection lens. Further, in a vehicle headlamp using a reflector as an optical component, the optical center is the focal point of the reflector. Furthermore, in a vehicle headlamp using a combination of a plurality of optical components, the optical center is the focal point of an optical component where light emitted from a light source module reaches first. The optical system of the vehicle headlamp is formed such that light passing through the optical center forms a light distribution pattern with the highest accuracy.

However, in employing the light source module disclosed in Patent Document 1, there is a concern that a light distribution pattern becomes blurred by the light emitted from the semiconductor light emitting elements that are positioned at both ends, separated from the middle of the array of the semiconductor light emitting elements. Moreover, when the semiconductor light emitting elements are connected in series, all the semiconductor light emitting elements emit light having substantially the same luminance. However, since the light emitted from the semiconductor light emitting elements, which are positioned at both ends of the array, is not efficiently used to form a light distribution pattern, loss of power consumption is large.

One or more embodiments of the present provides a light source module that can reduce loss of power consumption while forming an appropriate light distribution pattern, and a vehicle lamp using the light source module.

According to one aspect of the present invention, there is provided a light source module for a vehicle lamp. The light source module includes a plurality of semiconductor light emitting elements that are disposed in a straight line. The plurality of semiconductor light emitting elements is electrically connected to each other in series. The light emitting area of at least one of the semiconductor light emitting elements, which are positioned inside both ends of the light source module, is formed to be smaller than the light emitting area of each of the semiconductor light emitting elements that is positioned at an end of the light source module.

According to this aspect, the light emitting area of each of the semiconductor light emitting elements, which are positioned inside both ends of the light source module, is smaller than that of each of the semiconductor light emitting elements that are positioned at both ends of the light source module. Accordingly, current density becomes high, so that light-emitting luminance becomes high. If a vehicle lamp unit is formed using the light source module such that the optical center of the optical system is positioned on the middle line of the array of the semiconductor light emitting elements, the luminance of the semiconductor light emitting elements, which are positioned inside both ends of the light source module, is increased. Accordingly, the amount of light passing through the optical center of the optical system is increased, and thus it becomes possible to form a bright light distribution pattern with high accuracy. Further, since the luminance of a portion, which has relatively high use efficiency of light used to form a light distribution pattern, is increased, it may be possible to reduce loss of power consumption.

The light emitting areas of the semiconductor light emitting elements may be formed to be decreased toward the inside of the light source module from both ends of the light source module. In this case, the luminance of the semiconductor light emitting elements is increased from both ends of the array of the semiconductor light emitting elements toward the middle thereof. Since the proportion of light, which is effectively used to form a light distribution pattern, is increased toward the middle of the array of the semiconductor light emitting elements, the luminance of the semiconductor light emitting elements is increased from both ends of the array of the semiconductor light emitting elements toward the middle thereof. Accordingly, it may be possible to form a bright light distribution pattern with higher accuracy. Moreover, it may be possible to further reduce loss of power consumption.

The number of the semiconductor light emitting elements may be an odd number of 3 or more. The light emitting area of the semiconductor light emitting element, which is positioned in the middle, may be formed to be smaller than the light emitting area of each of the semiconductor light emitting elements that are positioned at both ends. In this case, it may be possible to form a more preferable light distribution pattern by positioning the optical center of the optical system on a line that passes through the semiconductor light emitting element positioned in the middle of the array. Further, it may be possible to suppress the generation of streaky lines that have low luminosity and are formed near the middle of the light distribution pattern.

According to another aspect of the invention, there is provided a vehicle lamp. The vehicle lamp emits light in a certain irradiation direction, and includes the above-mentioned light source module and an optical system. The optical system guides light, which is emitted from the light source module, in a certain irradiation direction. The optical system has its optical center on the middle line of an array of semiconductor light emitting elements that are arranged in a straight line.

According to this aspect, it may be possible to form a vehicle lamp that can reduce power consumption while forming a bright light distribution pattern with high accuracy.

According to one or more embodiments of the invention, it may be possible to provide a light source module that can reduce power consumption while forming an appropriate light distribution pattern, and a vehicle lamp using the light source module.

DETAILED DESCRIPTION

Embodiments of the invention will be described in detail below with reference to drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
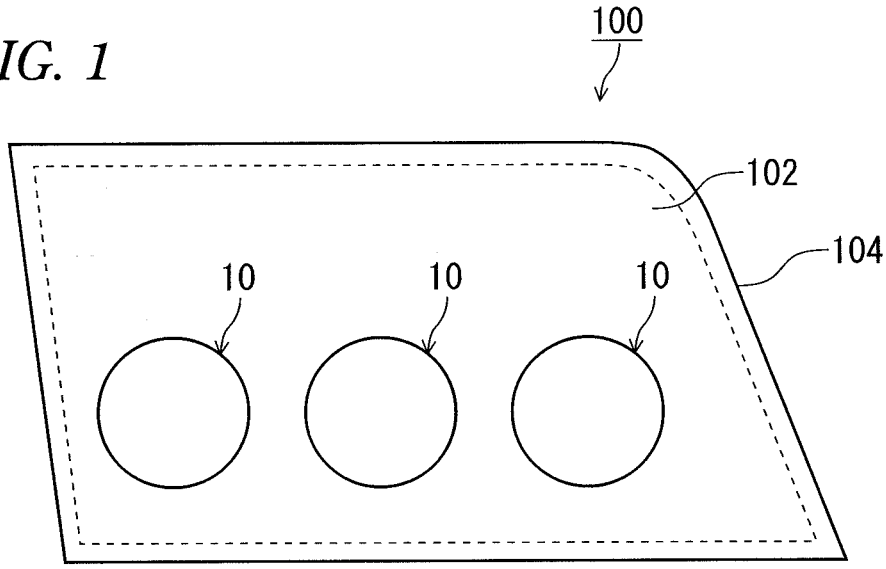
FIG. 1 is a front view of a vehicle lamp 100 according to an embodiment of the invention.

FIG. 1 is a front view of a vehicle lamp 100 according to an embodiment of the invention. For example, the vehicle lamp 100 is a low beam irradiation vehicle headlamp that emits light in a certain irradiation direction to the area in front of the vehicle. The vehicle lamp 100 includes three vehicle lamp units 10 that are arranged in a horizontal line and housed in a lamp chamber. The lamp chamber is formed by a lamp body 104 and a transparent cover 102 which allows most of light to penetrate therethrough without absorbing most of light.

These vehicle lamp units 10 have the same or similar structures. When the vehicle lamp 100 is mounted on a vehicle body, the vehicle lamp units are housed in the lamp chamber such that optical axes are tilted downward with respect to a longitudinal direction of a vehicle by an angle of about 0.3 to 0.6°. The vehicle lamp 100 forms a certain light distribution pattern by irradiating light to the area in front of the vehicle on the basis of the light that is emitted from the vehicle lamp units 10. The vehicle lamp 100 may include a plurality of vehicle lamp units 10 having different light distribution characteristics.

Figure 2:
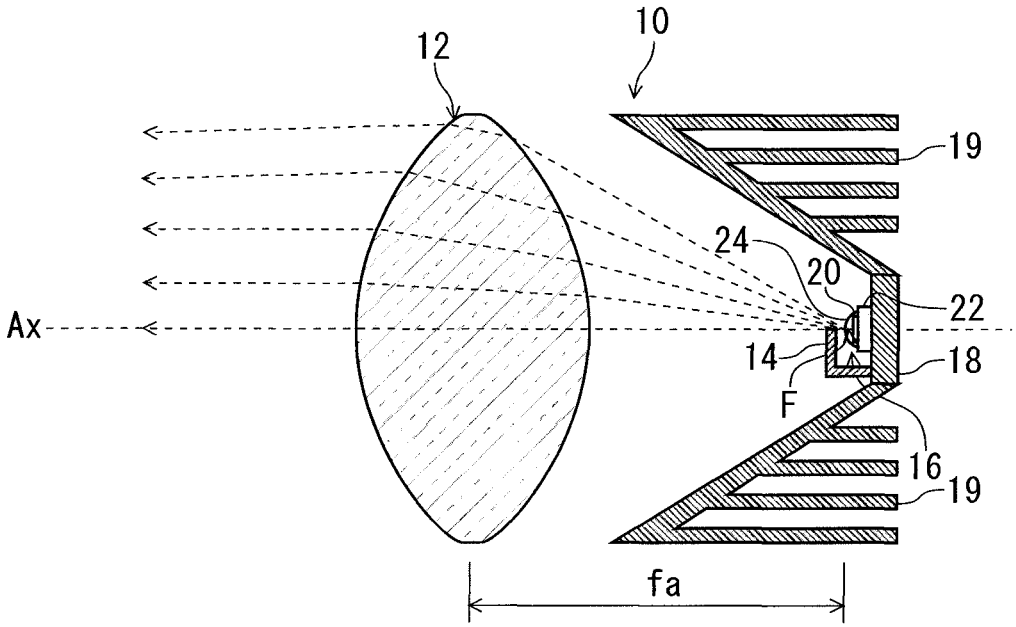
FIG. 2 is a side cross-sectional view of a vehicle lamp unit 10.

FIG. 2 is a side cross-sectional view of the vehicle lamp unit 10. The vehicle lamp unit 10 is a direct-projection type vehicle lamp unit that directly irradiates light, emitted from a light source module 16, to the area in front by a projection lens 12. As shown in FIG. 2, the vehicle lamp unit 10 includes a support member 18, a light shielding member 14, a light source module 16, and a projection lens 12.

The support member 18 is formed in a plate-like shape. The bottom of the light source module 16 is supported and fixed to the surface of the support member 18 facing the area in front of a vehicle, so that the support member allows the light source module 16 to emit light toward the area in front of a vehicle. In this embodiment, the support member 18 is provided so as to stand in a vertical direction. Heatsinks 19 are provided at upper and lower ends of the support member 18 to radiate heat generated from the light source module 16. The heatsinks 19 can prevent the deterioration of the light emission efficiency of the light source module 16.

The light shielding member 14 is formed in a plate-like shape, and is provided so as to face the upper surface of the support member 18 with the light source module 16 interposed therebetween. The light shielding member 14 blocks a part of light emitted from the light source module 16 at the upper edge portion thereof so as to define a boundary between brightness and darkness which is formed by light passing through the projection lens 12, on the basis of the shape of a projection image of the upper edge portion of the light shielding member in a forward direction. For example, the shape of the projection image is a linear shape that extends in a lateral direction of a vehicle. Further, the lower end of the light shielding member 14 is connected to the lower end of the support member 18. Accordingly, the light shielding member 14 is fixed to the support member 18. Meanwhile, the light shielding member 14 and the support member 18 may be formed integrally with each other.

The light source module 16 includes: a substrate 22 whose bottom surface is fixed on the support member 18; a plurality of semiconductor light emitting elements 20 arranged in a straight line on the upper surface of the substrate 22; and a translucent member 24 that seals the semiconductor light emitting elements 20. The translucent member 24 is made of a material, through which light emitted from the semiconductor light emitting elements 20 penetrates, such as a transparent resin. The arrangement direction of the plurality of semiconductor light emitting elements 20 of the light source module 16 is a lateral direction of a vehicle. Further, the light source module 16 is disposed such that the middle of the semiconductor light emitting elements 20 is positioned on an optical axis Ax of the projection lens 12. The light source module 16 will be described in details below.

Each of the front and rear surfaces of the projection lens 12 is a convex surface. That is, the projection lens 12 is formed of a convex lens whose both surfaces are convex, and a focal length fa of the projection lens is set to a relatively large value. The projection lens 12 is fixed to the support member 18 with a connecting member (not shown). The projection lens 12 is an optical system that is common to the plurality of semiconductor light emitting elements 20 of the light source module 16, and is provided in front of the light source module 16 in a vehicle forward direction, and irradiates light in a certain irradiation direction to the area in front of a vehicle by allowing the light emitted from the light source module 16 to pass therethrough. The projection lens 12 is disposed such that a rear focal point F of the projection lens as an optical center is positioned on the middle line of an array of the plurality of semiconductor light emitting elements.

In the vehicle lamp unit 10 having the above-mentioned structure, light emitted from the light source module 16 is converged to the optical axis Ax by the projection lens 12 and inversely irradiated to the front area. In this case, light, which is directed to the lower side of the optical axis Ax, of the light emitted from the light source module 16 is blocked by the light shielding member 14. Accordingly, light is not irradiated upwardly from the vehicle lamp unit 10 to the front area.

Figure 3:
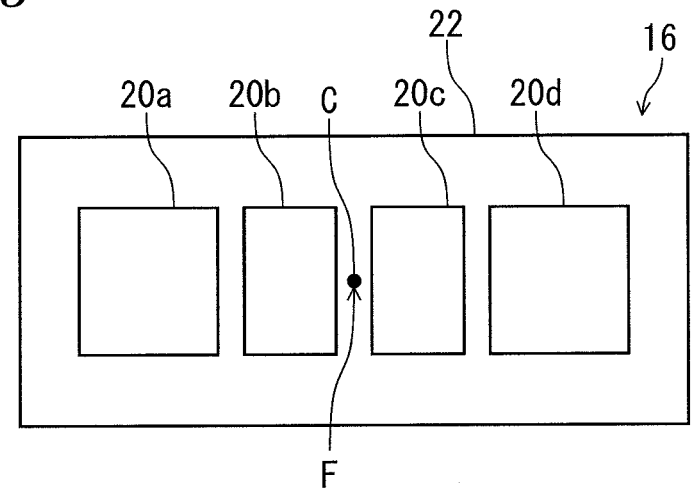
FIG. 3 is a view showing a light source module 16.

FIG. 3 is view showing the light source module 16. The light source module 16 is a linear light source that extends in the lateral direction of a vehicle. The light source module 16 includes: a substrate 22; a first semiconductor light emitting element 20*a*; a second semiconductor light emitting element 20*b*; a third semiconductor light emitting element 20*c*; a fourth semiconductor light emitting element 20*d*; and a translucent member. The translucent member is not shown in FIG. 3.

The first to fourth semiconductor light emitting elements 20*a* to 20*d* are disposed in a straight line at substantially regular intervals on the upper surface of the substrate 22 in the order of the first semiconductor light emitting element 20*a*, the second semiconductor light emitting element 20*b*, the third semiconductor light emitting element 20*c*, and the fourth semiconductor light emitting element 20*d* from the left side in top view. Each of the first to fourth semiconductor light emitting elements 20*a* to 20*d* is a white LED that emits white light. For example, each of the first to fourth semiconductor light emitting elements 20*a* to 20*d* allows a fluorescent body (not shown) that is formed on the surface thereof to emit yellow light by irradiating the fluorescent body with blue light, thereby emitting white light as the whole of the element. Almost the entire region of each of the upper surfaces of the first to fourth semiconductor light emitting elements 20*a* to 20*d* shown in FIG. 3 is a light emitting region.

In this embodiment, the first to fourth semiconductor light emitting elements 20*a* to 20*d* are electrically connected in series by a wiring pattern (not shown) that is formed on the substrate 22. That is, the anode of the first semiconductor light emitting element 20*a* is connected to the positive terminal of a power supply device (not shown), and the cathode thereof is connected to the anode of the second semiconductor light emitting element 20*b*. Further, the cathode of the second semiconductor light emitting element 20*b* is connected to the anode of the third semiconductor light emitting element 20*c*. Furthermore, the cathode of the third semiconductor light emitting element 20*c* is connected to the anode of the fourth semiconductor light emitting element 20*d*. Moreover, the cathode of the fourth semiconductor light emitting element 20*d* is connected to the negative terminal of the power supply device.

In addition, in this embodiment, the light emitting areas of the second and third semiconductor light emitting elements 20*b* and 20*c*, which are positioned inside both ends of the light source module, are formed to be smaller than the light emitting areas of the first and fourth semiconductor light emitting elements 20*a* and 20*d* that are positioned at both ends of the light source module. Each of the first and fourth semiconductor light emitting elements 20*a* and 20*d* is an LED chip whose light emitting area is about 1 mm square. Meanwhile, each of the second and third semiconductor light emitting elements 20*b* and 20*c* is a rectangular LED chip whose light emitting area has a length of about 1 mm in the vertical direction and a length of about 0.7 mm in the horizontal direction.

Since the first to fourth semiconductor light emitting elements 20*a* to 20*d* of the light source module 16 having the above-mentioned structure are connected in series, the same current flows through the first to fourth semiconductor light emitting elements 20*a* to 20*d* when a voltage is applied between the first and fourth semiconductor light emitting elements 20*a* and 20*d*. Further, the first to fourth semiconductor light emitting elements 20*a* to 20*d* are supplied with current, thereby emitting light. Here, since the light emitting area of each of the second and third semiconductor light emitting elements 20*b* and 20*c*, which are positioned inside both ends of the light source module, is smaller than that of each of the first and fourth semiconductor light emitting elements 20*a* and 20*d* that are positioned at both ends of the light source module, the current densities of the second and third semiconductor light emitting elements 20*b* and 20*c* are higher than those of the first and fourth semiconductor light emitting elements 20*a* and 20*d*. Accordingly, the light-emitting luminance of the second and third semiconductor light emitting elements 20*b* and 20*c*, which are positioned inside both ends of the light source module, becomes higher than that of the first and fourth semiconductor light emitting elements 20*a* and 20*d* that are positioned at both ends of the light source module.

When being assembled with the vehicle lamp unit 10 shown in FIG. 2, the light source module 16 of this embodiment is disposed such that the rear focal point F of the projection lens 12 is positioned on the middle line C of the array of the four semiconductor light emitting elements as described above.

Figure 4:
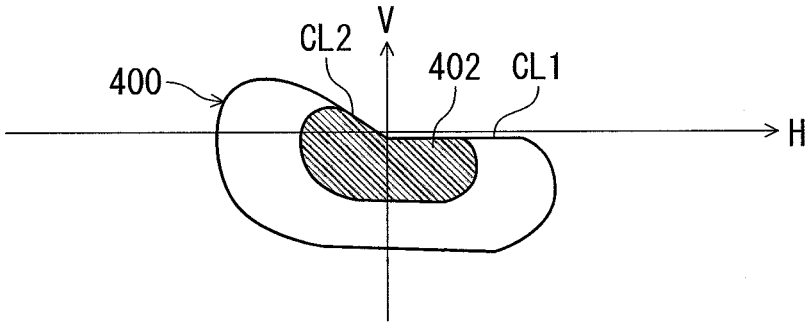
FIG. 4 is a view showing an example of a light distribution pattern of the vehicle lamp.

FIG. 4 is a view showing an example of a light distribution pattern of the vehicle lamp 100. A light distribution pattern 400 shown in FIG. 4 is a left low beam light distribution pattern that is formed on a virtual vertical screen disposed at a position 25 m ahead of the vehicle lamp 100. The light distribution pattern 400 is formed as a combined light distribution pattern of the three vehicle lamp units 10 of the vehicle lamp 100. The light distribution pattern 400 includes a horizontal cut line CL1 and an oblique cut line CL2 that define a boundary between brightness and darkness in a vertical direction at the upper end thereof.

The horizontal cut line CL1 is set slightly below the front (an intersection between a horizontal axis H and a vertical axis V) of the vehicle lamp 100 (set slightly below the front of the vehicle lamp 100 by an angle of about 0.5 to 0.6°). The oblique cut line CL2 is inclined to the upper left side from the intersection between the vertical axis V and the horizontal cut line CL1 at an angle of about 15°. The horizontal cut line CL1 of the light distribution pattern 400 is formed by a horizontal edge of the upper edge portion of the light shielding member 14. Meanwhile, the oblique cut line CL2 is formed by an oblique edge of the upper edge portion of the light shielding member 14. A region of the light distribution pattern near the intersection between the horizontal axis H and the vertical axis V is called a hot zone 402, and it is preferable that the region of the light distribution pattern near the intersection between the horizontal axis and the vertical axis be more brightly illuminated than other regions of the light distribution pattern 400 from the viewpoint of safety.

The forming accuracy of the horizontal cut line CL1 and the oblique cut line CL2 of the light distribution pattern will be examined herein. In this embodiment, the first to fourth semiconductor light emitting elements 20*a* to 20*d* are connected in series and the light emitting areas of the semiconductor light emitting elements, which are positioned inside both ends of the light source module, are formed to be smaller than the light emitting areas of the semiconductor light emitting elements that are positioned at both ends of the light source module. Accordingly, the light-emitting luminance of the second and third semiconductor light emitting elements 20*b* and 20*c*, which are positioned inside both ends of the light source module, becomes higher than that of the first and fourth semiconductor light emitting elements 20*a* and 20*d* that are positioned at both ends of the light source module. If the vehicle lamp unit 10 is formed using the light source module 16 such that the rear focal point F of the projection lens 12 as the optical center of the optical system is positioned on the middle line C of an array of the semiconductor light emitting elements, the luminance of the second and third semiconductor light emitting elements 20*b* and 20*c*, which are close to the rear focal point F and positioned inside both ends of the light source module, is increased. Accordingly, the amount of light passing through the rear focal point F is increased. In general, the optical system of the vehicle lamp unit is formed such that light passing through the optical center forms a light distribution pattern with the highest accuracy. Accordingly, if the amount of light passing through the rear focal point F is increased, it may be possible to clearly form the horizontal cut line CL1 and the oblique cut line CL2 of the light distribution pattern.

Further, if the amount of light passing through the rear focal point F of the projection lens 12 is increased, it may be possible to brightly illuminate the hot zone 402. Furthermore, since the luminance of only the second and third semiconductor light emitting elements 20*b* and 20*c*, which are positioned inside both ends of the light source module and have relatively high use efficiency of light used to form a light distribution pattern, is increased, it may be possible to reduce loss of power consumption.

Figure 5:
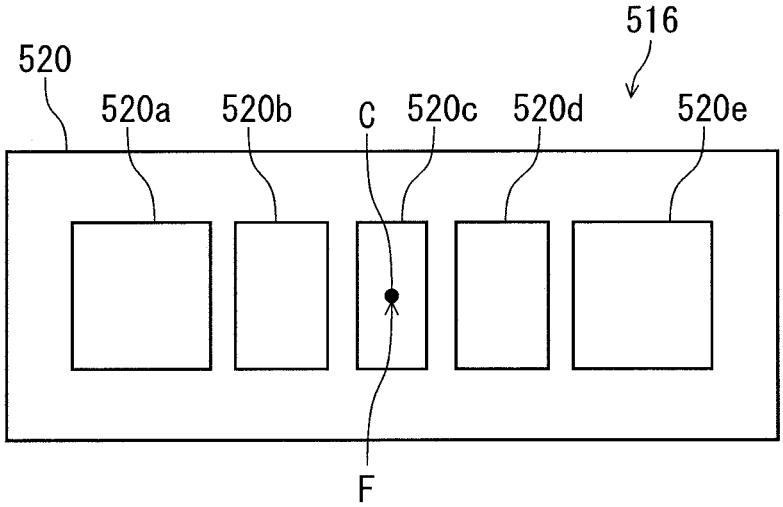
FIG. 5 is a view showing a light source module 516.

FIG. 5 is a view showing a light source module 516. The light source module 516 shown in FIG. 5 is another example of the light source module that can be assembled with the vehicle lamp unit 10. The light source module 516 includes five semiconductor light emitting elements, that is, a first semiconductor light emitting element 520*a*, a second semiconductor light emitting element 520*b*, a third semiconductor light emitting element 520*c*, a fourth semiconductor light emitting element 520*d*, and a fifth semiconductor light emitting element 520*e* that are disposed in a straight line in this order from the left side in top view.

In the light source module 516, the first to fifth semiconductor light emitting elements 520*a* to 520*e* are electrically connected to each other in series. Further, in the light source module 516, the light emitting areas of the semiconductor light emitting elements are formed to be decreased toward the inside from both ends of the light source module. Specifically, each of the first and fifth semiconductor light emitting elements 520*a* and 520*e*, which are positioned at both ends of the light source module, is an LED chip whose light emitting area is about 1 mm square. Further, each of the second and fourth semiconductor light emitting elements 520*b* and 520*d*, which are located next to the second semiconductor light emitting elements positioned at both ends of the light source module, is a rectangular LED chip whose light emitting area has a length of about 1 mm in the vertical direction and a length of about 0.7 mm in the horizontal direction. Furthermore, the third semiconductor light emitting element 520*c*, which is positioned in the middle of the light source module, is an LED chip whose light emitting area has a length of about 1 mm in the vertical direction and a length of about 0.5 mm in the horizontal direction.

When being assembled with the vehicle lamp unit 10 shown in FIG. 2, the light source module 516 is disposed such that the rear focal point F of the projection lens 12 is positioned on the middle line C of an array of the semiconductor light emitting elements passing through the third semiconductor light emitting element 520*c* positioned in the middle of the light source module.

Since the first to fifth semiconductor light emitting elements 520*a* to 520*e* of the light source module 516 having the above-mentioned structure are connected to each other in series, the same current flows through the first to fifth semiconductor light emitting elements 520*a* to 520*e* when a voltage is applied between the first to fifth semiconductor light emitting elements 520*a* to 520*e*. Further, when being supplied with current, the first to fifth semiconductor light emitting elements 520*a* to 520*e* emit light. Here, due to the difference in light emitting area, the luminance of the third semiconductor light emitting element 520*c* positioned in the middle of the light source module is the highest among the first to fifth semiconductor light emitting elements 520*a* to 520*e*, the luminance of the second and fourth semiconductor light emitting elements 520*b* and 520*d* next to the third semiconductor light emitting element 520*c* is the second highest, and the luminance of the first and fifth semiconductor light emitting elements 520*a* and 520*e* positioned at both ends of the light source module is the lowest.

As described above, in the light source module 516, the luminance of the semiconductor light emitting elements is increased from both ends of the array of the semiconductor light emitting elements toward the middle thereof. Since a proportion of light, which is effectively used to form a light distribution pattern, is increased from both ends of the array of the semiconductor light emitting elements toward the middle thereof in the vehicle lamp unit 10 assembled with the light source module 516, it may be possible to form a clearer light distribution pattern. Accordingly, it may be possible to further reduce loss of power consumption.

Further, since five (odd number) semiconductor light emitting elements are arranged in a straight line in the light source module 516, the middle line C of the array of the semiconductor light emitting elements passes through the third semiconductor light emitting element 520*c*. If the light source module 516 is disposed such that the rear focal point F of the projection lens 12 is positioned on the middle line C of the third semiconductor light emitting element 520*c*, the amount of light passing through the rear focal point F is increased as compared to the case of the light source module 16 where four (even number) semiconductor light emitting elements as shown in FIG. 3 are arranged in a line in the light source module 516. Further, since the middle of the array of the semiconductor light emitting elements is positioned at the third semiconductor light emitting element 520*c*, it may be possible to suppress the generation of streaky lines that have low luminosity and are formed near the middle of the light distribution pattern. Meanwhile, an example where five semiconductor light emitting elements are disposed has been described in this embodiment. However, three or more (odd number) semiconductor light emitting elements may be disposed in a straight line, and the light emitting area of a semiconductor light emitting element positioned in the middle of a light source module may be smaller than that of each of the semiconductor light emitting elements that are positioned at both ends of the light source module.

Figure 6:
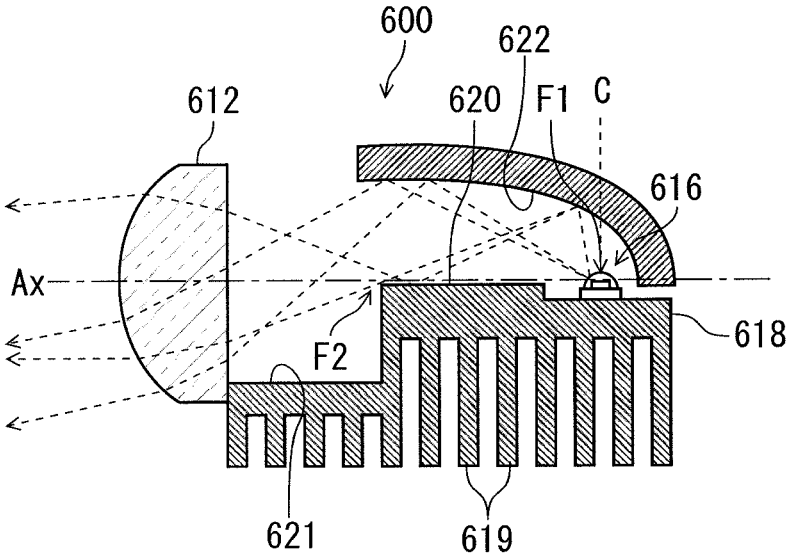
FIG. 6 is a side cross-sectional view of a vehicle lamp unit 600.

FIG. 6 is a side cross-sectional view of a vehicle lamp unit 600. The vehicle lamp unit 600 shown in FIG. 6 is another example of the vehicle lamp unit that is housed in the vehicle lamp 100. The vehicle lamp unit 600 includes: a support member 618; a light source module 616; a reflecting mirror 620; a projection lens 612; and a reflector 622. The vehicle lamp unit 600 is a projector type lamp unit that focuses and reflects light, which is emitted from the light source module 616, on the optical axis Ax and irradiates light to the area in front through the projection lens 612.

The support member 618 is a plate-like member that supports the light source module 616, the reflector 622, the projection lens 612, and the like. A rear portion of the support member 618 is a plate-like body whose upper surface is substantially horizontal, and the bottom of the light source module 616 is placed and fixed on the upper surface of the rear portion of the support member 618. The light source module 16 shown in FIG. 3 or the light source module 516 shown in FIG. 5 is used as the light source module 616. The light source module 616 is fixed on the upper surface of the support member 618 so that the light emitting surfaces of the semiconductor light emitting elements face the upper side and the arrangement direction of the semiconductor light emitting elements corresponds to the lateral direction of the vehicle.

The reflecting mirror 620 is a reflecting mirror that reflects light on a substantially horizontal upper surface thereof, and is provided between the light source module 616 and the projection lens 612. The reflecting mirror 620 is formed by a mirror treatment such as aluminum deposition, on the upper surface of the support member 618. The reflecting mirror 620 may be provided inside the surface of the light source module 616, including the plurality of semiconductor light emitting elements. In this case, it may be possible to make light, which is emitted from the light source module 616, efficiently enter the projection lens 612. Further, a front edge portion of the reflecting mirror 620 linearly extends substantially in a lateral direction of a vehicle. Alternatively, the front edge portion of the reflecting mirror 620 may be formed to correspond to a cut line to be formed, more specifically, in a substantially V shape.

The projection lens 612 is provided in front of the reflecting mirror 620 and a reflector 622 in a vehicle forward direction. The projection lens 612 transmits light, which is reflected by the reflecting mirror 620 or the reflector 622, and irradiates the light in a certain irradiation direction to the area in front of the vehicle. The projection lens 612 is supported by a bracket portion 621 that is formed at the front end of the support member 618. In this embodiment, the projection lens 612 has a rear focal point near the front edge of the reflecting mirror 620, and forms at least a part of the light distribution pattern of the vehicle lamp by projecting an image, which is formed on a focal plane including the rear focal point, to the area in front of the vehicle.

A plurality of fins 619 is provided on the lower surfaces of the support member 618 and the bracket portion 621. Heat, which is generated in the light source module 616, is radiated by the fins 619. Thus, it may be possible to prevent the deterioration of the light emission efficiency of the light source module 616 that is caused by heat.

The reflector 622 is an optical component that is common to the plurality of semiconductor light emitting elements of the light source module 616. In this embodiment, the reflector 622 is provided so as to surround the back, sides, and top of the light source module 616. Further, the reflector 622 irradiates light from the light source module 616 in a certain irradiation direction by reflecting light, which is emitted from the light source module 616, to the front side and allowing the light to enter the projection lens 612.

In this embodiment, at least a part of the reflector 622 has the shape of an elliptic spherical surface that is formed of, for example, a composite ellipsoidal surface or the like. Further, the elliptic spherical surface is set so that the cross-sectional shape of the elliptic spherical surface including the optical axis Ax of the vehicle lamp unit 600 forms at least a part of an elliptical shape. Furthermore, the eccentricity of the elliptical shape is set so as to gradually increase from a vertical cross-section toward the horizontal cross-section.

Moreover, a portion of the reflector 622, which has the shape of an elliptic spherical surface, has a first focal point F1 and a second focal point F2. The first focal point F1 is an example of the optical center of an optical system, and located at substantially the center of the light source module 616. The second focal point F2 is located near the front end of the reflecting mirror 620.

In this embodiment, the light source module 616 is disposed such that the first focal point F1 as the optical center is positioned on the middle line C of the semiconductor light emitting elements. In this case, the reflector 622 focuses most of the light, which is emitted from the light source module 616, near the front edge of the reflecting mirror 620.

Here, the reflector 622 is configured such that light having passed through the first focal point F1 is focused on the second focal point F2. Accordingly, a part of the light, which is emitted from a position separated from the middle line C of the light source module 616, cannot pass through the first focal point F1 and is not accurately focused on the second focal point F2. That is, a part of the light, which is emitted from a position separated from the middle line C of the light source module 616, is not effectively used to form a light distribution pattern.

Accordingly, the light source module 16 shown in FIG. 3 or the light source module 516 shown in FIG. 5 is used as the light source module 616 in the vehicle lamp unit 600 according to this embodiment. In this case, the luminance of the semiconductor light emitting elements, which are close to the first focal point F1 and positioned inside both ends of the light source module, becomes higher than those of the semiconductor light emitting elements that are positioned at both ends of the light source module, which is separated from the first focal point. The amount of light, which contributes to the formation of a light distribution pattern having a high accuracy, is increased and the amount of light, which contributes less to the formation of a light distribution pattern, is decreased. Accordingly, it may be possible to clearly form the horizontal cut line CL1 and the oblique cut line CL2 of the light distribution pattern. Further, it may be possible to reduce loss of power consumption.

Figure 7:
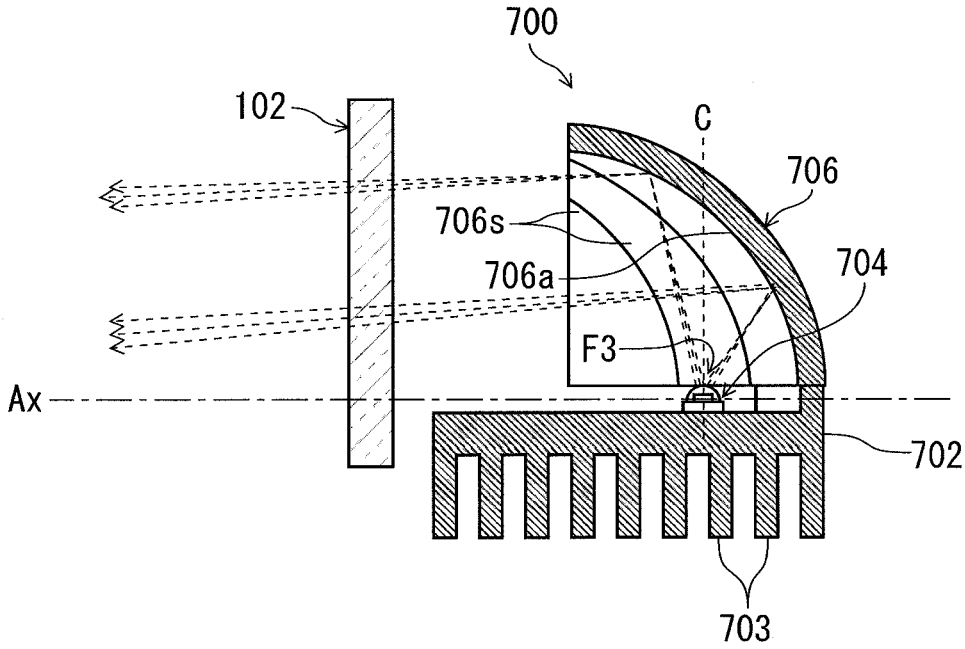
FIG. 7 is a side cross-sectional view of a vehicle lamp unit 700.

FIG. 7 is a side cross-sectional view of a vehicle lamp unit 700. The vehicle lamp unit 700 shown in FIG. 7 is still another example of the vehicle lamp unit that is housed in the vehicle lamp 100. The vehicle lamp unit 700 includes a support member 702, a light source module 704, and a reflector 706. The vehicle lamp unit 700 is a reflector type lamp unit.

The support member 702 is a plate-like body whose upper surface is substantially horizontal, and the bottom surface of the light source module 704 is placed and fixed on the upper surface of the support member. The light source module 16 shown in FIG. 3 or the light source module 516 shown in FIG. 5 is used as the light source module 704. The light source module 704 is fixed on the upper surface of the support member 702 so that the light emitting surfaces of the semiconductor light emitting elements face upwardly and the arrangement direction of the semiconductor light emitting elements corresponds to the lateral direction of the vehicle.

A plurality of fins 703 is provided on the lower surface of the support member 702. The support member 702 functions as a heatsink for radiating heat that is generated in the light source module 704 by the fins 703, and can prevent the deterioration of the light emission efficiency of the light source module 704 that is caused by heat.

The reflector 706 is provided above the light source module 704, and has a substantially parabolic reflecting surface 706*a*. The reflecting surface 706*a* is a reflecting surface based on a paraboloid of revolution whose central axis corresponds to the optical axis Ax, and has a focal point F3 as an optical center. A plurality of diffusion reflecting elements 706*s* is formed on the reflecting surface 706*a* in the shape of vertical stripes. The diffusion reflecting angles of these diffusion reflecting elements 706*s* in the lateral direction are different from each other. The lower end portion of the reflector 706 is fixed to the support member 702.

Further, in the vehicle lamp unit 700, light emitted from the light source module 704 is reflected to the front area as light, which is slightly tilted downward and diffused in the lateral direction, by the reflector 706, and is irradiated to the area in front of the lamp through the transparent cover 102 of the vehicle lamp 100 shown in FIG. 1.

In this embodiment, the light source module 704 is disposed such that the focal point F3 as an optical center is positioned on the middle line C of the array of the semiconductor light emitting elements. In this case, the reflector 706 irradiates most of the light, which is emitted from the light source module 704, to the area in front of the lamp.

Here, since the reflector 706 is configured such that light having passed through the focal point F3 forms an appropriate light distribution pattern, a part of the light, which is emitted from a position separated from the middle line C of the light source module 704, cannot pass through the focal point F3 and does not contribute to the formation of an appropriate light distribution pattern. That is, a part of the light, which is emitted from a position separated from the middle line C of the light source module 704, is not effectively used to form a light distribution pattern.

Accordingly, the light source module 16 shown in FIG. 3 or the light source module 516 shown in FIG. 5 is used as the light source module 704 in the vehicle lamp unit 700 according to this embodiment. In this case, the luminance of the semiconductor light emitting elements, which are close to the focal point F3 and positioned inside both ends of the light source module, becomes higher than those of the semiconductor light emitting elements that are positioned at both ends of the light source module which is separated from the focal point. The amount of light, which contributes to the formation of a light distribution pattern having a high accuracy, is increased and the amount of light, which contributes less to the formation of a light distribution pattern, is decreased. Accordingly, it may be possible to clearly form the horizontal cut line CL1 and the oblique cut line CL2 of the light distribution pattern. Further, it may be possible to reduce loss of power consumption.

The present invention has been described above with the embodiments. These embodiments are illustrative, and it is understood by those skilled in the art that the combination of the respective components or processes may have various modifications and the modifications are also included in the scope of the invention.

In the above-mentioned embodiments, an element formed of one chip has been used as one semiconductor light emitting element. However, an element where a plurality of light emitting regions are formed on one chip may be used. In this case, electrodes corresponding to the plurality of light emitting regions are electrically connected in series, and the plurality of light emitting regions is arranged in a straight line at given intervals.

Further, the number of the semiconductor light emitting elements, which are arranged in a straight line in the light source module, is not limited to the above-mentioned value. As long as the number of the semiconductor light emitting elements is three or more, an arbitrary number of semiconductor light emitting elements may be used. Furthermore, a ratio of the light emitting area of each of the semiconductor light emitting elements, which are positioned inside both ends of the light source module, to the light emitting area of each of the semiconductor light emitting elements, which are positioned at both ends of the light source module, is also not particularly limited to the above-mentioned value. For example, the short side of each of the semiconductor light emitting elements, which are positioned inside both ends of the light source module, may be formed to be as small as one fifth of the short side of each of the semiconductor light emitting elements, which are positioned at both ends of the light source module.

This application is based on Japanese Patent Application No. 2008-111815 filed on Apr. 22, 2008, the contents of which are incorporated herein by reference.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A light source module for a vehicle lamp, including an optical system that guides light emitted from the light source module in a certain irradiation direction and has an optical center, the light source module comprising:

a plurality of semiconductor light emitting elements disposed in a straight line and electrically connected to each other in series, wherein one of the semiconductor light emitting elements that is positioned closest to the optical center of the optical system has a light emitting area that is smallest of the plurality of the semiconductor light emitting elements.

2. The light source module according to claim 1, wherein the light emitting areas of the semiconductor light emitting elements decrease toward the inside of the light source module from both ends thereof.

3. The light source module according to claim 1, wherein a number of the plurality of semiconductor light emitting elements is an odd number of 3 or more, and wherein one of the semiconductor light emitting elements that is positioned in the middle of the light source module has a light emitting area that is smaller than a light emitting area of each of the semiconductor light emitting elements positioned at an end of the light source module.

4. A vehicle lamp that emits light in a certain irradiation direction, comprising:

the light source module according to claim 1; and an optical system that guides light emitted from the light source module, in the certain irradiation direction, wherein the optical system has an optical center on a middle line of the light source module.

5. The light source module according to claim 3, wherein the one of the semiconductor light emitting elements that is positioned at the center of the light source module has a light emitting area that is smallest of the plurality of the semiconductor light emitting elements.

6. The vehicle lamp according to claim 4, wherein the optical system comprises: a projection lens disposed such that a rear focal point of the projection lens is positioned on the middle line of the light source module.

7. The vehicle lamp according to claim 4, wherein the optical system comprises: a reflector disposed such that a focal point of the reflector is positioned on the middle line of the light source module.

8. The light source module according to claim 1, wherein end semiconductor light emitting elements of the plurality of semiconductor light emitting elements positioned at both ends of the light source module are formed in a square shape, and at least one of the plurality of semiconductor light emitting elements positioned between the end semiconductor light emitting elements is formed in a non-square rectangular shape.

* * * * *